United States Patent [19]

Ruck

[11] 4,388,077

[45] Jun. 14, 1983

[54] COMPOSITION FOR WASHING FABRIC

[75] Inventor: Jules B. Ruck, St. Albert, Canada

[73] Assignee: W. E. Greer Ltd., Edmonton, Canada

[21] Appl. No.: 291,188

[22] Filed: Aug. 7, 1981

[51] Int. Cl.[3] ..... D01C 1/02

[52] U.S. Cl. ..... 8/138; 252/8.6; 252/8.8; 252/524; 252/527; 252/542; 252/DIG. 7; 252/140; 252/142

[58] Field of Search ..... 252/99, 135, 527, DIG. 7, 252/136, 142, 524, 542, 174.14, 139, 89.1, 140, 8.6, 8.8 R; 8/139, 138

[56] References Cited

U.S. PATENT DOCUMENTS

| | | | |
|---|---|---|---|
| 3,042,621 | 7/1962 | Kirschenbauer | 252/99 |
| 3,522,175 | 7/1970 | Katsumi et al. | 252/8.8 |
| 3,644,203 | 2/1972 | Lamberti et al. | 252/8.75 |
| 3,704,228 | 11/1972 | Eckert et al. | 252/117 |
| 3,888,797 | 6/1975 | Marumo | 252/527 |
| 3,951,879 | 4/1976 | Wixon | 252/547 |
| 4,058,489 | 11/1977 | Hellsten | 252/8.8 |
| 4,093,417 | 6/1978 | Heinlein et al. | 252/8.6 |
| 4,157,388 | 6/1979 | Christiansen | 252/8.8 |
| 4,303,542 | 12/1981 | Heinlein et al. | 252/91 |

FOREIGN PATENT DOCUMENTS 1964023 6/1971 Fed. Rep. of Germany .

*Primary Examiner*—John E. Kittle
*Assistant Examiner*—Hoa Van Le
*Attorney, Agent, or Firm*—Ernest P. Johnson

[57] ABSTRACT

A composition is provided for washing fabric, particularly denim, prior to sale. The composition includes an amphoteric surfactant, a builder which ensures that the surfactant in a washing solution, is initially in an anionic state, and a pH builder which causes the pH of the washing solution to decrease to thereby change the amphoteric surfactant to its cationic state. In its anionic state the surfactant acts as a wetting agent to encourage such actions as pre-shrinking and dye-bleeding by the washing solution. In its cationic state the surfactant can be adsorbed onto the fabric so as to exhibit fabric softening and anti-static effects. A lubricant is preferably included in the composition to reduce uneven dye-bleeding caused by fabric to fabric abrasion in the wash cycle.

11 Claims, No Drawings

COMPOSITION FOR WASHING FABRIC

BACKGROUND OF THE INVENTION

The present invention relates to a composition for use in washing fabric, particularly for washing denim, prior to sale.

In the textile and clothing industries, it is desirable to wash fabrics or clothing to accomplish one or more of the following actions: bleed excess dyes, pre-shrink fabric, improve the hand of the fabric and remove sizing, a stiffening agent added to stiffen the fabric to facilitate the fabric cutting operation. To date this washing action has been done using a conventional laundry detergent. These detergents typically include one or both of non-ionic or anionic surfactants, detergent builders such as phosphates, silicates, carbonates, borates, and organic builders, which builders act to raise the pH and density of the washing solution and act as chelates, soil anti-redeposition agents such as carboxymethyl cellulose, optical brighteners, and fillers such as sodium chloride and sodium sulphate. A typical washing procedure using these detergents includes a standard 15–20 minute wash cycle, a 4 minute souring rinse to remove the alkalinity developed by the detergent, a 3 minute fresh water rinse, a 4 minute fabric softening rinse and a 3 minute water extraction cycle. Thus considerable time and energy are spent in a washing procedure. A washing composition to reduce the time and energy consumed by this washing procedure is desirable.

Attempts have been made to develop washing compositions which both clean and soften fabric in one washing cycle; see for example U.S. Pat. No. 3,704,228 issued to Eckert et al., British Pat. No. 1,329,416 issued to Samuel et al., U.S. Pat. No. 3,888,797 issued to Marumo, and U.S. Pat. No. 3,951,879 issued to Wixon.

These compositions typically include a surfactant, usually non-ionic, to achieve a cleaning effect, and an amphoteric surfactant or a quaternary salt to achieve a softening effect. These compositions need to be used in an alkaline washing solution in order to achieve a cleaning action. In an alkaline environment however, neither the amphoteric or the quaternary is thus in a form which will readily adsorb onto the fabric. For this reason these compositions fail to give sufficient softening or anti-static properties to the fabrics. Furthermore the costs of including both a non-ionic surfactant and an amphoteric surfactant or quaternary salt in these compositions increase the costs of these compositions. To the inventor's knowledge these compositions are not used in the fabric washing industry.

Another serious problem in the fabric washing art is that the washed fabric is often streaked from uneven dye removal. This problem is especially prevalent with washed denim apparel. The streaked fabric or apparel is sold as a factory sub-standard, at a significantly reduced price.

SUMMARY OF THE INVENTION

In accordance with the present invention a composition is provided for use in washing fabric, particularly for washing denim. The composition includes an amphoteric surfactant, which, in the aqueous washing solution, changes from an anionic to a cationic state in response to a decrease in the solution pH. In the anionic state, the surfactant acts as a wetting agent to allow the aqueous washing solution to wet the fabric and thereby bleed fabric dyes, shrink the fabric and remove fabric sizing. In the cationic state, the surfactant can be adsorbed onto the fabric to achieve a fabric softening effect. Preferred amphoteric surfactants include disubstituted imidazolines with $C_6$ to $C_{22}$ aliphatic acid substituents, for example a stearyl immidazoline, an oleyl imidazoline, and mixtures thereof, or dicarboxylic $C_8$ to $C_{18}$ aliphatic acid derivatives of a sodium, potassium or amine salt. Examples of suitable amine functions are mono-, di- and tri-ethanolamine and isopropanolamine.

The composition also includes one or more acid and/or alkaline builders to give an initial washing solution pH which ensures that the amphoteric surfactant is initially in its anionic state. Generally the initial solution pH should be slightly alkaline. Preferred builders include perborate salts, phosphate salts and organic builders. The builder is preferably chosen to give an initial pH in the range of about 7.1 to 8.0 units.

To cause the solution pH to drop and to thereby change the amphoteric surfactant to its cationic state, the composition further includes a pH builder which dissociates at the initial solution pH to form an acid, which acid reduces the solution pH. Preferably the pH builder is a carbonate salt, for example sodium carbonate or sodium bicarbonate, which dissociates to form carbonic acid.

In a preferred embodiment of the invention, the composition further includes a lubricant, for example a light mineral oil or a metal carboxylate salt. The lubricant reduces fabric to fabric abrasion during the wash cycle, which abrasion was discovered to be one of the major causes of uneven dye bleeding from the fabric.

Broadly stated, the invention is a composition for washing fabric, comprising an amphoteric surfactant which, in an aqueous solution, changes from an anionic state to a cationic state in response to a decrease in the solution pH; a builder to give an initial solution pH which ensures that the surfactant is in the anionic state; and a pH builder which dissociates at the initial solution pH to form an acid, which acid reduces the solution pH, causing the surfactant to change to the cationic state.

In another broad aspect of the invention, there is a method for washing fabric which comprises washing the fabric in an aqueous washing solution containing an amphoteric surfactant which, in the washing solution changes from an anionic state to a cationic state in response to a decrease in the solution pH, a builder to give an initial solution pH which ensures that the surfactant is in the anionic state, and a pH builder which dissociates at the initial solution pH to form an acid, which acid reduces the solution pH causing the surfactant to change to the cationic state.

DESCRIPTION OF THE PREFERRED EMBODIMENT

The washing composition of the present invention includes an amphoteric surfactant, an alkaline and/or an acid builder, a pH builder, and preferably a lubricant.

While not being bound by the same, the action of an amphoteric surfactant in an aqueous washing solution is believed to be as follows. An amphoteric surfactant, in solution, will change from an anionic to a cationic state with a given change in the solution pH. This pH range varies with different amphoterics, but usually involves a change from a slightly alkaline solution to a slightly acidic solution. In its anionic state, the amphoteric acts as a wetting agent in the washing solution. Little or no cleaning action is required of the washing composition since the fabric to be washed is essentially clean. Water itself causes much of the desired bleeding of both the fabric dyes and the fabric sizing, and the pre-shrinking of the fabric. However, a wetting agent is required to enable the water to so act on the fabric. In its cationic state, the amphoteric, in solution, is adsorbed onto the fabric to act as a fabric softener and an anti-static agent. The fabric is generally negatively charged in the washing solution, and thus the cationic amphoteric can be adsorbed.

To cause the above described transition of the amphoteric surfactant, the washing composition includes firstly, in addition to the amphoteric surfactant, a builder, which in solution ensures that the amphoteric is initially in the anionic state, and secondly, a pH builder, which in solution, slowly decreases the solution pH to cause the amphoteric to change to its cationic state. The builder is usually chosen such that it gives an initial solution pH which is slightly alkaline. The pH builder is usually chosen to cause a gradual decrease of the solution pH to a final slightly acidic condition. The builder and pH builder are of course modified should the amphoteric surfactant being used resonate between anionic and cationic states in another pH range.

The amphoteric surfactant is preferably either a disubstituted imidazoline with $C_6$ to $C_{22}$ aliphatic acid substituents, for example distearyl or dioleyl imidazoline, or a dicarboxylic $C_8$ to $C_{18}$ aliphatic acid derivative of a sodium, potassium or amine salt. Exemplary amine functions are mono-, di- , or tri-ethanolamine and isopropanolamine. The dicarboxylic-type surfactant is generally preferred since it maintains a high net charge while in solution, and, depending on the substituents, has excellent fabric softening ability. The most preferable dicarboxylic acid-type surfactant used is a dicarboxylic caprylic derivative sodium salt. The surfactant is typically included in the composition in an amount in the range of about 0.5 to 10 percent by weight.

The builder is preferably chosen from the selected group of conventional detergent builders consisting of phosphate salts, perborate salts and organic builders. Exemplary builders include sodium perborate, trisodium phosphate, carboxymethylcellulose. As mentioned the builder is included to give an initial solution pH which ensures that the surfactant is in its anionic state. For most amphoteric surfactants the initial solution pH must be slightly alkaline. Preferably the builder buffers the solution pH in the range of about 7.1 to 8.0. The builder is generally included in the composition in an amount in the range of about 1.0 to 25 percent by weight.

The pH builder is chosen to dissociate slowly at the initial solution pH set by the builder, to form an acid. Carbonate salts which dissociate at the initial solution pH to form carbonic acid are suitable for this purpose. Preferably carbonate salts include sodium carbonate and sodium bicarbonate. The pH builder is preferably included in the composition in an amount in the range of about 10 to 70 percent by weight.

The lubricant used in the composition is preferably selected from the group of metal carboxylates, for example an aluminum, zinc or magnesium salt of a carboxylate of about 9 to 28 carbon atoms, for example a stearic or oleic acid, and light mineral oils. The term light mineral oil is meant to include mineral oils having a viscosity in the range of about 60 to 200 cps and a flash point greater than 100° C. The light mineral oils are most preferably due to their low cost in comparison to the metal carboxylates. The lubricant is preferably included in the composition in an amount in the range of about 0.5 to 15 percent by weight.

Optional ingredients in the composition include conventional optical brighteners, soil anti-redeposition agents, fragrances, colour, and inert fillers. These optional ingredients may be included in the composition in an amount in the range of about 5 to 95 percent by weight, mutually cumulative.

The composition can be manufactured in either a liquid or a powder form. The liquid composition is obtained by simply mixing together the above-listed ingredients. The powder composition is obtained by adsorbing the liquid composition onto an inert filler by methods known in the detergent industry.

The invention is further illustrated in the following example.

EXAMPLE

Washing compositions were prepared in accordance with the following formula.

| Ingredients | % By Weight |
|---|---|
| Amphoteric surfactant—(see below) | 4.000 |
| Builders—Sodium perborate | 10.000 |
| —Trisodium phosphate | 4.000 |
| —Carboxymethyl cellulose | 1.000 |
| pH Builder—Sodium carbonate | 15.000 |
| Lubricant—(see below) | 3.000 |
| Optical Brightener—Tinopal UNPA' | 0.500 |
| Colour—Blue (1% solution in isopropanol) | 0.005 |
| Filler—Sodium Chloride | 62.495 |

'Trade name of Ciba Giegy Chemical Corp., Greensboro, North Carolina

| Surfactants | |
|---|---|
| A | Miranol J2M—a dicarboxylic caprylic derivative sodium salt, trade name of Miranol Chemical Co. Inc., Irvington, N.J. |
| B | Miranol L2M—a dicarboxylic linoleic |
| C | Miranol M2M—a dicarboxylic myristic |
| D | Amphoterge LZ—a cocohydroxyethyl imidazoline, trade name of Lonza Inc., Bayport, Tx, Long Beach, Ca. |
| E | Ammonyx 2000—a distearylethylbenzyl ammonium chloride, trade name Onyx Oil & Resins Inc., Jersey City, N.J. |

| Lubricants | |
|---|---|
| 1. | Mineral Oil—Blandol, trade name of Imperial Oil Chemicals Division, Edmonton, Alberta. |
| 2. | Aluminum Stearate |
| 3. | Magnesium Stearate |

The compositions were prepared in a powder form by simply mixing the ingredients with the sodium chloride filler.

To test the effectiveness of the compositions, each composition was added to a wash load of no more than 280 finished 12 oz. denim garments in no more than 600 Imp. gallons of cold water. The garments were washed for 6 minutes, cold water rinsed for 2 minutes and spun dry at high speed for 4 minutes.

When the compositions were included in amounts of 3 lb./60 Imp. Gal., the initial solution pH was found to range from about 7.9 to 8.1 depending on the water hardness. The solution pH just prior to the rinse cycle ranged from about 6.4 to 6.8.

While all of the above compositions performed satisfactorily in the washing procedure, their performance is tabulated qualitatively in Table 1 below. The compositions are indicated in short-form notation. For example A1 refers to a composition including the surfactant Miranol J2M and the lubricant mineral oil.

TABLE I

| Test | Washing Composition | | | | | | |
|---|---|---|---|---|---|---|---|
| Parameter | A1 | B1 | C1 | D1 | E1 | A2 | A3 |
| Dye Bleed | E | F | F | F | P | E | VG |
| Even Colour | E | E | E | P | P | P | P |
| Softness | E | G | G | VG | E | VG | G |

Notes:
E = excellent, VG = very good, G = good, F = fair, and P = poor

While the present invention has been disclosed in connection with the preferred embodiment thereof, it should be understood that there may be other embodiments which fall within the spirit and scope of the invention as defined by the following claims.

The embodiments of the invention in which an exclusive property or privilege is claimed are defined as follows:

1. A method of washing denim, containing excess dye and sizing, comprising:
washing the denim in an aqueous solution containing an amphoteric surfactant, selected from the group consisting of at least one of a dicarboxylic aliphatic acid derivative of about 8 to 18 carbon atoms and a disubstituted imidazoline of about 6 to 22 carbon atoms, one or more builders, selected from the group consisting of perborate salts, phosphate salts, and organic builders, a carbonate salt pH builder, a metal carboxylate salt lubricant, and a light mineral oil lubricant; and
rinsing and drying the denim.

2. The method as set forth in claim 1 wherein:
the surfactant is selected from the group consisting of a distearyl imidazoline, a cocohydroxyethyl imidazoline, a dicarboxylic caprylic derivative sodium salt, a dicarboxylic linoleic derivative, and a dicarboxylic myristic derivative.

3. The method as set forth in claim 2 wherein:
the builder is selected from the group of sodium perborate, trisodium phosphate and carboxymethyl cellulose.

4. The method as set forth in claim 3 wherein:
the builder is a carbonate salt selected from the group consisting of sodium carbonate and sodium bicarbonate.

5. The composition as set forth in claim 1 wherein:
the amphoteric surfactant is provided in an amount between about 0.5 to 10 percent by weight;
the builder is provided in an amount between about 1.0 to 25 percent by weight;
the carbonate salt pH builder is provided in an amount between about 10 to 70 percent by weight;
and the lubricants together are provided in an amount between about 0.5 to 15 percent by weight.

6. A composition for washing denim, containing excess dye and sizing, comprising:
an amphoteric surfactant selected from the group consisting of a dicarboxylic aliphatic acid derivative of 8 to 18 carbon atoms and a disubstituted imidazoline of 6 to 22 carbon atoms;
one or more builders selected from the group consisting of perborate salts, phosphate salts, and organic builders;
a carbonate salt pH builder;
a metal carboxylate salt lubricant; and
a light mineral oil lubricant.

7. The composition as set forth in claim 6 wherein:
the surfactant is selected from the group consisting of a distearyl imidazoline, a cocohydroxyethyl imidazoline, a dicarboxylic caprylic derivative sodium salt, a dicarboxylic linoleic derivative, and a dicarboxylic myristic derivative.

8. The composition as set forth in claim 7 wherein:
the builder is selected from the group of sodium perborate, trisodium phosphate and carboxymethyl cellulose.

9. The composition as set forth in claim 7 wherein:
the carbonate salt is selected from the group consisting of sodium carbonate and sodium bicarbonate.

10. The composition as set forth in claim 6 wherein:
the amphoteric surfactant is provided in an amount between about 0.5 to 10 percent by weight;
the builder is provided in an amount between about 1.0 to 25 percent by weight;
the pH builder is provided in an amount between about 10 to 70 percent by weight;
and the lubricants together are provided in an amount between about 0.5 to 15 percent by weight.

11. The composition as set forth in claim 7 wherein:
the amphoteric surfactant is provided in an amount between about 0.5 to 10 percent by weight;
the builder is provided in an amount between about 1.0 to 25 percent by weight;
the pH builder is provided in an amount between about 10 to 70 percent by weight;
and the lubricants together are provided in an amount between about 0.5 to 15 percent by weight.

* * * * *